US005351955A

United States Patent [19]

Danby

[11] Patent Number: 5,351,955

[45] Date of Patent: Oct. 4, 1994

[54] BOARD GAME APPARATUS AND SPINNER ASSEMBLY

[75] Inventor: Mary Danby, Ashampstead, England

[73] Assignee: Hasbro, Inc., Pawtucket, R.I.

[21] Appl. No.: 71,537

[22] Filed: Jun. 4, 1993

[51] Int. Cl.[5] ..... A63F 9/00

[52] U.S. Cl. ..... 273/141 R; 273/236; 273/287

[58] Field of Search ..... 273/141 R

[56] References Cited

U.S. PATENT DOCUMENTS 1,538,889 5/1925 Farnum ..... 273/141 R
2,186,337 1/1940 Jackson ..... 273/141 R

FOREIGN PATENT DOCUMENTS 685138 4/1964 Canada ..... 273/141 R

*Primary Examiner*—Benjamin H. Layno
*Attorney, Agent, or Firm*—Kurt R. Benson

[57] ABSTRACT

A spinner assembly for a board game includes a counterweighted spinner arm. The counterweighted spinner arm is rotatably and pivotably mounted on a spindle which is mounted to a game board. The spinner arm includes an elongated arm portion which extends, outwardly from the spindle, a platform member on the elongated arm and a counterweight portion which extends outwardly from the spindle in an opposite direction from the elongated arm. The counter weight portion includes a weighted ball element which centrifugally rolls outwardly in the counterweight portion away from the spindle when the spinner arm is rotating about said spindle to pivot the arm portion upwardly and counterbalance the platform member above the game board. The ball element gravitationally rolls inwardly in the counterweight portion towards the spindle when rotation of the spinner arm is reduced to a level sufficient to cause the weight of the ball element to overcome the centrifugal force applied thereto, whereby the platform member is caused to slowly descend onto the game board.

13 Claims, 3 Drawing Sheets

BOARD GAME APPARATUS AND SPINNER ASSEMBLY

BACKGROUND OF THE INVENTION

The instant invention relates to board games and more particularly to a board game assembly and a spinner assembly therefor.

Spinner apparatus and spinning devices are well known in the toy art, and in this regard a wide variety of toys and board games have been heretofore available which have included such devices. For example, the U.S. Pat. No. 1,538,889 to Farnum is illustrative of such a device. The Farnum device comprises a base having a plurality of concave depressions in the surface thereof and a spinning arm which is operative for holding a ball by centrifugal force when the arm is spinning rapidly and for dropping the ball onto the base when rotation of the arm slows to a point where the centrifugal force on the ball is no longer strong enough to hold it in the arm.

SUMMARY OF THE INVENTION

The instant invention provides a unique board game apparatus and spinner assembly.

The game apparatus preferably comprises a game board, a spinner assembly, a plurality of character cards, a plurality of game pawns, a plurality of wish tokens, and a plurality of rescue cards.

The game board includes a plurality of scene areas thereon which radiate outwardly from a center of the board. The spinner assembly includes a base portion which is releasably mounted to the game board, a counterweighted spinner arm rotatably and pivotably mounted on a spindle on the base portion, a support element mounted on the spindle above the spinner arm, a second game board mounted on the support element and a conventional spinner element rotatably mounted on the support element above the second game board. The spinner arm comprises an elongated arm portion which extends outwardly from the spindle, a platform member on the arm portion, and a counterweight portion which extends outwardly from the spindle in an opposite direction from the arm portion. The counterweight portion provides a variable counterweight which is operable for pivoting the arm portion upwardly and counterbalancing the weight of the elongated arm portion and the platform member, in addition to a varying number of game pawns which may be received on the platform member when the spinner arm is rotating about the spindle. The counterweight portion includes a weighted ball element which is moved radially outwardly in the counterweight portion away from the spindle by the centrifugal forces which act thereon when the spinner arm is rotating about the spindle to pivot the arm portion upwardly and counterbalance the platform member above the game board. However, the weighted ball element is gravitationally moved radially inwardly in the counterweight portion towards the spindle when rotation of the spinner arm slows down causing the counterbalancing effect of the ball element to be reduced and thereby causing the platform member to slowly descend onto the game board in a manner which simulates the descent of a mythical magic carpet.

The game apparatus as herein embodied further comprises four player cards which represent animated characters and a fifth character card which represents a "Genie" character. The apparatus further comprises four game pawns which correspond to the four player cards. Each of the game pawns is adapted to be received on a seat on the platform member. The apparatus still further comprises a total of sixteen numbered rescue cards which correspond to the eight animated scene areas depicted on the game board.

The apparatus of the instant invention is operable in an amusing game in which the spinner apparatus of the instant invention simulates the flight and descent of a mythical magic carpet. In this regard, while it will be understood that the apparatus, including the spinner assembly, can be effectively utilized in a variety of different games, one specific and particularly amusing form of the apparatus and a corresponding set of game rules is set forth herein.

For play of the game, each player is given one of the four character cards, a corresponding game token, three wish tokens and a plurality of rescue cards. During game play, the players take turns during which they attempt to discard rescue cards and collect the genie card. Successive play continues until one player has discarded all of his/her rescue cards and collected the genie card. That player is the winner.

Accordingly, it is an object of the instant invention to provide a spinner assembly for use in a board game.

It is another object to provide a spinner assembly including a counterweighted spinner arm which pivots the arm portion and counterbalances the weight of a platform member above the game board when the spinner am is rotating and which enables the platform member to slowly descend onto the game board when rotation of the spinner arm slows down.

It is yet another object to provide a variable counterweight which is operable for counterbalancing the weight of the spinner arm in addition to a variable number of game pawns which may be received on the spinner arm.

It is still another object of the invention to provide a spinner assembly having a counterweighted spinner arm and a second conventional spinner.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
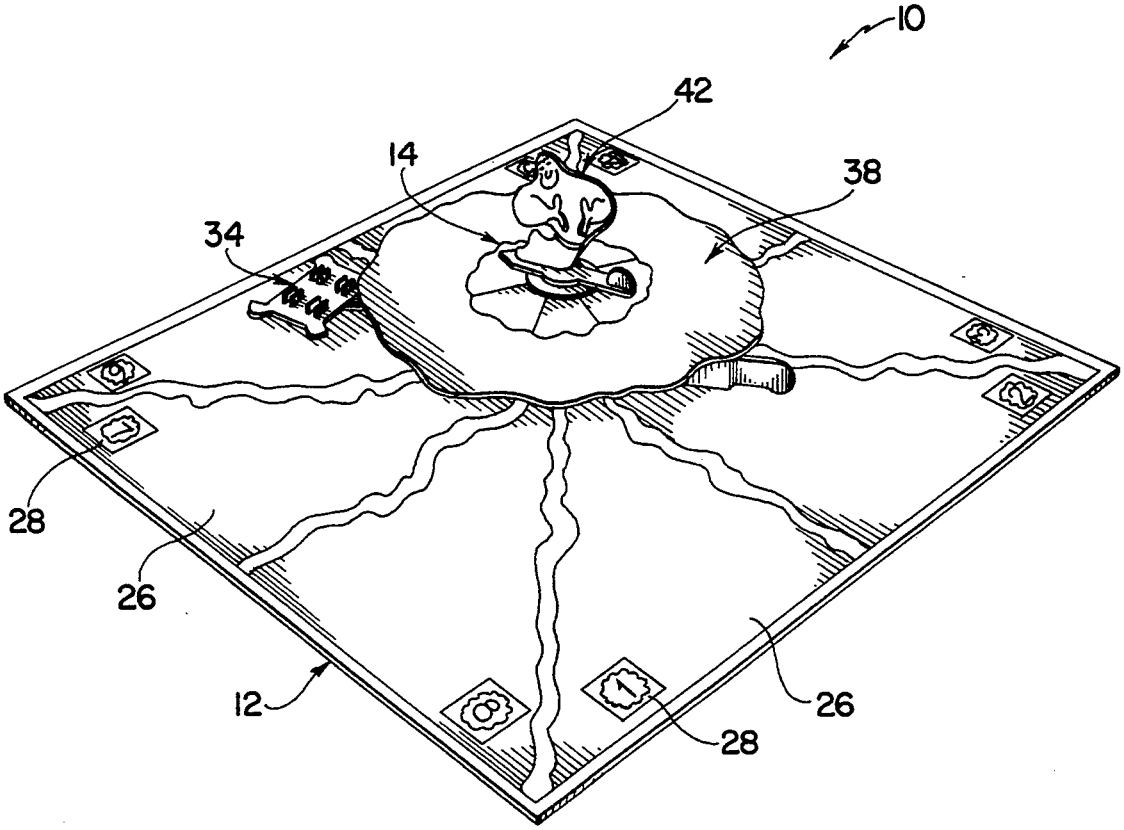
FIG. 1 is a perspective view of the game apparatus of the instant invention.
Figure 2:
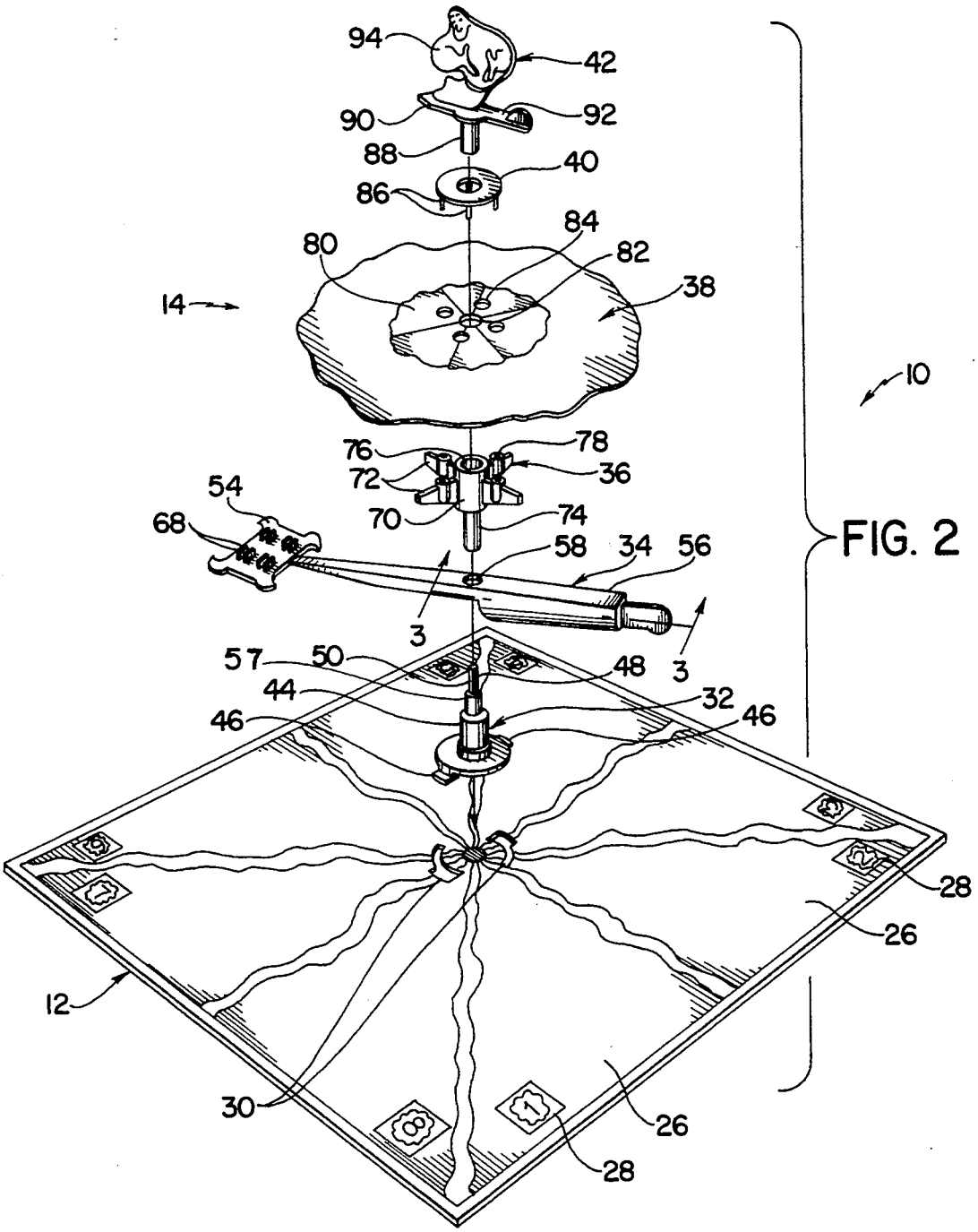
FIG. 2 is an exploded perspective view thereof.
Figure 3:
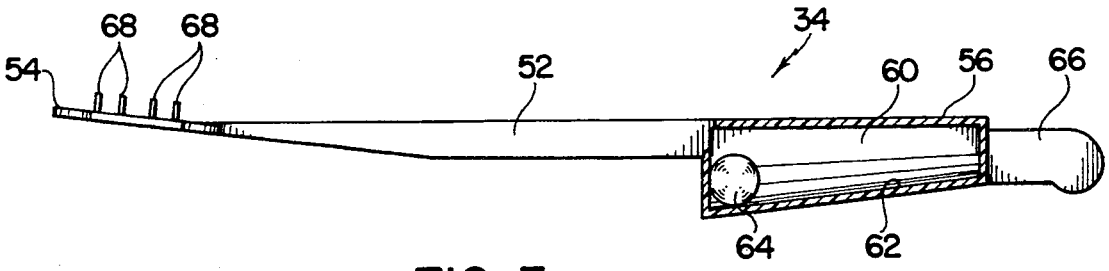
FIG. 3 is an elevational view of the spinner arm with the counterweight portion thereof shown in cross section.
Figure 4:
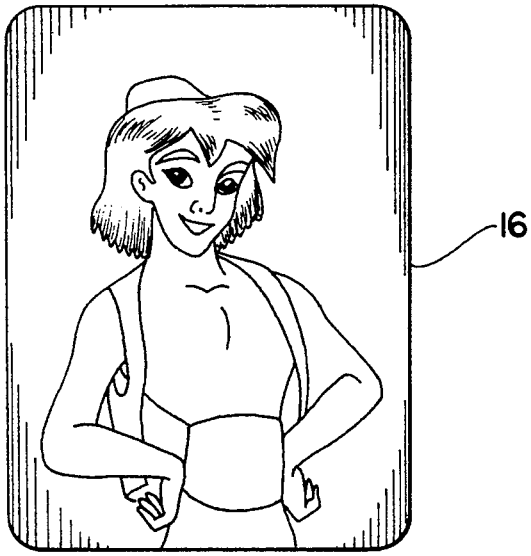
FIG. 4 is an elevational view of one of the character cards.
Figure 5:
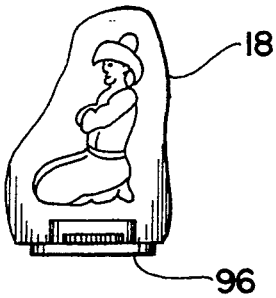
FIG. 5 is an elevational view of one of the game pawns.
Figure 6:
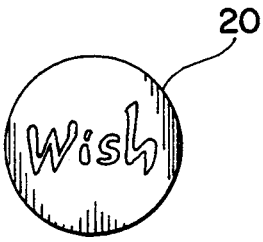
FIG. 6 is an elevational view of one of the wish tokens.
Figure 7:
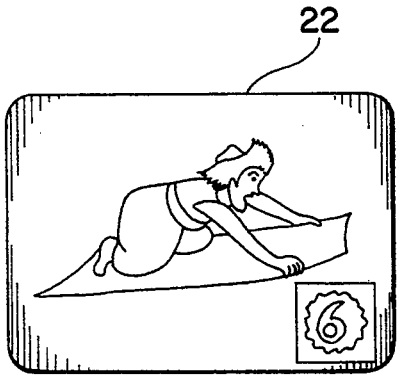
FIG. 7 is an elevational view of one of the rescue cards.

Referring now to the drawings, the game apparatus of the instant invention is illustrated and generally indicated at 10 in FIGS. 1 and 2. The game apparatus 10, which will hereinafter be more fully disclosed, is operative in a parlor type board game which is based on a mythical "Genie" and a magic carpet. The game apparatus 10 comprises a game board generally indicated at 12, a spinner assembly generally indicated at 14, a plurality of character cards 16, a plurality of game pawns 18, a plurality of "wish" tokens 20, a plurality of rescue cards 22, and a plurality of card clips 24.

The game board 12 is preferably fashioned from a stiff paperboard material, and it is generally square in configuration. The game board 12 includes a plurality of triangular spaces 26 which radiate outwardly from a center area of the game board 12. Printed within the boundaries of each space 26 is a fanciful animated scene depicting one of the game characters in trouble. Each space includes a respective numerical indicator 28 (1 through 8) thereon. The game board 12 further includes a pair of arcuate slots 30 which are located near the center area of the game board 12.

The spinner assembly 14 comprises a base portion generally indicated at 32, a counterweighted spinner arm generally indicated at 34, a support element generally indicated at 36, a second game board generally indicated at 38, a cap member 40, and a conventional spinner element generally indicated at 42.

The base portion 32 comprises a body 44, a pair of circumferentially spaced tabs 46, and a spindle 48. The tabs 46 are received in the arcuate slots 30 in the game board 12 for releasably mounting the base portion 32 to the game board 12. More specifically, the tabs 46 are inserted into the slots 30, and the base portion 32 is rotated clockwise to lock the tabs 46 in the slots 30. The spindle 48 includes a flat surface 50 for preventing rotation of the support member 36 which is mounted thereon.

The spinner arm 34 is rotatably and pivotably mounted on the spindle 48 and it comprises an elongated arm portion 52, a platform member 54 or "magic carpet" at one end of the arm portion 52, and a counterweight portion 56. An aperture 58 is formed in the spinner arm 34 between the elongated arm portion 52 and the counterweight portion 56 and the aperture is received over the spindle 48 so that the elongated arm portion 52 extends outwardly from the spindle 48 in one direction and the counterweight portion 56 extends outwardly from the spindle 48 in an opposite direction. In this regard, the spinner arm 34 rests on the shoulder 57 of the spindle 48 so that the spinner arm 34 is both rotatably and pivotably supported above the game board 12. (See FIG. 2). The spinner arm 34 is situated so that the platform member 54 normally rests on the game board 12. (See FIG. 1). The counterweight portion 56 provides a variable counterweight which is operable for pivoting the arm portion 52 upwardly and counterbalancing the weight of the elongated arm portion 52, and the platform member 54, in addition to a varying number of game pawns 18 which may be received on the platform member 54 when the spinner arm 32 is rotating about the spindle 48. The counterweight portion comprises a housing 60, a supporting surface 62 in the housing 60 which slopes upwardly away from the spindle 48, a weighted ball element 64 which is received on the supporting surface 62, and a tab 66. When the spinner arm 32 is rotating, the centrifugal forces applied to the ball element 64 cause the ball element 64 to roll upwardly on the supporting surface 62 away from the spindle 48 whereby the weight of the ball element 64 pivot the arm portion upwardly and counterbalances the weight of the elongated arm 52 the platform member 54, plus a variable number of game pawns 18 so that the platform member 54 appears to float over the surface of the game board 12. When rotation of the spinner arm 32 slows, the centrifugal force on and the ball element 64 are decreased causing the ball element to gravitationally roll downwardly on the supporting surface 52 toward the spindle 48 whereby the platform member 54 slowly descends onto the game board 12 in a random position. The lighter the weight on the platform member 54, i.e. the fewer number of game pawns 18 received on the platform member 54, the more "magically" the platform member 54 will descend. In this connection, when the platform 54 is empty, the spinner arm 32 actually stops in mid-air and then slowly descends onto the game board, and when the platform is carrying its maximum weight, i.e. four game pawns, the platform 54 slowly descends as rotation of the spinner am 32 slows down. In contrast, if the counterweight element 64 did not move radially, but instead was fixed in position, the platform would rapidly drop onto the board and come to a skidding stop, and furthermore the loading on the platform 54 could not be varied. The tab 66 facilitates rotation of the spinner arm 32 during play. The platform member 54 includes four sets of upwardly projecting tabs or seats 68 thereon which are adapted to receive the game pawns 18 thereon for "floating" movement around the game board 12. The support element 36 comprises a cylindrical body portion 70, a plurality of circumferentially spaced arm members 72 extending outwardly from the body portion 70, and a reduced diameter neck portion 74 projecting downwardly from the body portion 70. The neck portion 74 includes an axial bore (not shogun) having a flat surface which corresponds with the flat surface 50 on the spindle 48. The neck portion 74 is slidably received over the spindle 48 wherein the corresponding flat surfaces engage to prevent the support element 36 from rotating with respect to the spindle 48. The body portion 70 also includes an axial bore 76 which is adapted to receive the spindle of conventional spinner element 42. The arm portions 72 each include a tubular projection 78 thereon.

The second game board 38 is generally circular in configuration and it is also preferably fashioned from a stiff paperboard material. The second game board preferably includes a plurality of printed spaces 80 or sections thereon which radiate outwardly from the center of the game board 38. The spaces 80 indicate different actions to be taken during play of the game. The second game board 38 further includes a central aperture 82 and a plurality of circumferentially spaced apertures 84 which correspond with the tubular projections 78 on the arm members 72 of the support element 36. The second game board 38 is received on top of the support element 36 wherein the apertures 82 and 84 are received in engagement with the body portion 70 and tubular projections 78 on the support element 36. It can be appreciated that when the second game board 38 is mounted on the support element 36, it effectively hides from view the elongated arm portion 52 and counterweight portion 56 of the spinner arm 34 so that only the platform member 54 extends outwardly beyond the peripheral edges of the second game board 38. In this manner, the platform member 54 appears to float around the game board 12 when the spinner arm 34 is rotating.

The cap member 40 comprises an annular ring having a plurality of cylindrical posts 86 which project downwardly from the cap member 40. The cylindrical posts 86 are received into the tubular projections 78 on the support element 36 to capture the spinner board 38 between the arm members 72 and the annular cap member 40.

The conventional spinner element 42 comprises a central spindle 88, a first arm member 90 extending outwardly from the spindle 88, a second arm member 92 extending outwardly from the spindle 88 in an opposite direction from the first arm member 90 and a character FIG. 94 (a mythical Genie) on the spindle 88. The spindle 88 is rotatably received in the axial bore 76 in the support member 36 for rotation above the second game board 38. The conventional spinner element 42 operates in a conventional manner as is well known in the art.

Figure 8:
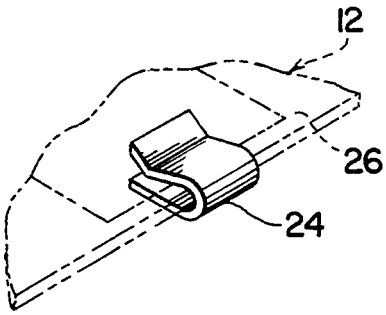
FIG. 8 is a perspective view of one of the card clips.
Figure 9:
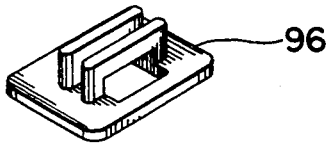
FIG. 9 is a perspective view of one of the pawn bases.

The character cards 16 comprise four player cards which represent four animated game characters and a fifth character card which represents a "Genie" character. There are four game pawns 18 which correspond to the four player cards 16, and each of the game pawns 18 is mounted in a pawn base 96 (FIG. 9) which is adapted to be received over the tabs or seats 68 on the platform member 54. Preferably there are a total of sixteen numbered rescue cards 22, wherein there are two cards which correspond to each of the eight animated scenes 26 depicted on the game board 12. The card clips 24 are operative for releasably clipping the rescue cards 22 to the game board 12, and they are snap received on the edges of the game board 12 adjacent each scene 26 as illustrated in FIG. 8.

PREFERRED GAME RULES

For play of the game, one player is chosen to shuffle the four character cards 16 and to deal one card face-up to each of the players. The character on the card received is the character which the player represents in the game. Each player then receives a game token 18 corresponding to the character card received. Next, each player receives three "wish" tokens 20. The rescue cards 22 are then shuffled and each player receives four rescue cards 22 face-up. In a two or three player game, more than four rescue 22 cards may be distributed to each player so long as each player receives an equal number of cards 22. The card clips 24 are snap received over the edges of the game board 12 adjacent the numerical indicator 28 in each animated scene 26.

The youngest player plays first. On each player's turn, the object is to discard one of rescue cards 22 which the player holds. This can be done in either of two ways: by giving a card 22 to another player; or by playing a card 22 on the game board 12. Each turn begins by spinning the "genie" spinner (the conventional spinner) 42 and following the directions in the space 80 on which the spinner 42 lands on. In this regard, the second game board 38 is divided into six sections or spaces 80 which have the following designations: give a card; genie; wish (2 spaces); or carpet (2 spaces). If the spinner 42 points to the "give a card" space, the player may give one of his/her rescue cards 22 to another player. This ends the player's turn. If the spinner 42 points to the "genie" space, the player may take possession of the genie card 16 (possession of the genie card is required to win the game once the player has discarded of all of his/her rescue cards). This ends the player's turn. If the spinner 42 points to a "wish" space, the player has two choices; choose any one of the rescue cards 22 and play it on the game board 12 by placing it under the clip 24 on the corresponding scene space 26; or take the genie card 16. One of the player's wish tokens 20 must then be turned over to indicate it has been used. This ends the player's turn. Once all three of the player's wish tokens 20 have been used, the player's turn ends when the spinner 42 lands on a wish space. If the spinner 42 lands on a "carpet" space, the player must do the following; if the player's game pawn 18 is not on the "magic carpet" (platform member) 54, the player must place the game pawn 18 onto one of the seats 68 on the platform member 54; or if the game pawn 18 is already on the magic carpet 54, the player must spin the spinner arm 32. When the platform member 54 descends onto the game board 12, the player may be able to play a rescue card 22 if he/she holds a rescue card 22 which matches the scene 26 on which the platform member 54 landed. If the player has a matching number rescue card 22, he must clip it to the game board scene 26 and then remove his game pawn 18 from the platform member 54 and place it on the game board 12. The player's turn is then over. If the player does not have a matching rescue card 22, the player must leave the game pawn 18 on the platform member 54 and the player's turn is over. Please note that each player who has a game pawn 18 on the platform member 54 has a chance to play a rescue card 22 when the platform member 54 lands on a scene 26. The rules are the same for all players who have game pawns 18 on the platform member 54. Successive play continues until one player has discarded all of his/her rescue cards 22 and collected the genie card 16. That player is the winner.

It is seen therefore that the game apparatus 10 of the instant invention provides an amusing and novel spinner assembly 14 which has significant play value. The spinner assembly 14 includes a unique counterweighted spinner arm 32 which is effective for balancing a platform member 54 and one, two, three or four game pawns 18 above the game board as the spinner arm 32 rotates around a central spindle 48 and for slowly lowering the platform member 54 onto the game board 12 when rotation of the spinner arm 32 slows down. The counterweighted spinner arm includes a weighted ball element which rolls outwardly to compensate for the variable weight of the platform and the game pawns. When the ball rolls inwardly, it renders the spinner arm 32 weightless, so that the platform 54, even if empty, will slowly descend onto the game board 12. The spinner assembly 14 further includes a second game board 38 mounted above the spinner arm 32 and a conventional spinner 42 mounted for rotation above the second game board 38. For these reasons, the game apparatus 10 and spinner assembly 14 of the instant invention are believed to represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A spinner assembly comprising:

a base portion which is adapted to be received on a supporting surface;

an upright spindle on said base portion; and a spinner arm rotatably and pivotably mounted on said spindle, said spinner arm including an elongated arm portion extending outwardly from said spindle, and a counterweight portion extending outwardly from said spindle in an opposite direction from said elongated arm portion, said elongated arm portion normally resting on said supporting surface, said counterweight portion including a weighted counterweight element which is centrifugally moved outwardly in the counterweight portion away from the spindle during rotation of said spinner arm to pivot said elongated arm portion upwardly and counterbalance the elongated arm portion above said supporting surface, said counterweight element being gravitationally moved inwardly in said counterweight portion towards the spindle when rotation of said spinner arm is reduced to a level sufficient to cause the weight of said counterweight element to overcome the centrifugal force applied thereto, whereby the elongated arm portion is caused to slowly descend onto the supporting surface.

2. In the spinner assembly of claim 1, said counterweight portion including a housing and a supporting surface in said housing which slopes upwardly away from said spindle, said counterweight element comprising a ball element which is received in said housing on said supporting surface, said ball element rolling upwardly on said supporting surface away from said spindle when said spinner arm is rotating about said spindle to pivot said elongated arm portion upwardly and counterbalance the elongated arm portion above said supporting surface, and said ball element rolling downwardly on said supporting surface towards the spindle when rotation of said spinner is reduced to a level sufficient to cause the weight of said ball element to overcome the centrifugal force applied thereto, whereby the elongated arm portion is caused to slowly descend onto the supporting surface.

3. In the spinner assembly of claim 1, said elongated arm portion including platform means at one end thereof.

4. A spinner assembly comprising:

a base portion which is adapted to be received on a supporting surface;

an upright spindle on said base portion; and a spinner arm rotatably and pivotably mounted on said spindle, said spinner arm including an elongated arm portion extending outwardly from said spindle, and a counterweight portion extending outwardly from said spindle in an opposite direction from said elongated arm portion, said elongated arm portion normally resting on said supporting surface, said counterweight portion including a weighted counterweight element which is centrifugally moved outwardly in the counterweight portion away from the spindle during rotation of said spinner arm to pivot said elongated arm portion upwardly and counterbalance the elongated arm portion above said supporting surface, said counterweight element being gravitationally moved inwardly in said counterweight portion towards the spindle when rotation of said spinner arm is reduced to a level sufficient to cause the weight of said counterweight element to overcome the centrifugal force applied thereto, whereby the elongated arm portion is caused to slowly descend onto the supporting surface, said spinner assembly further comprising a support element fixedly mounted on said spindle so as not to rotate about said spindle, and a second spinner element rotatably mounted on said support element.

5. Game apparatus comprising:

game board means having a center area and a plurality of angular spaces which radiate outwardly from said center area;

a spinner base mounted in said center area of said game board means;

an upright spindle on said spinner base; and a spinner arm rotatably and pivotably mounted on said spindle and comprising an elongated arm portion which extends outwardly from said spindle, and a counterweight portion which extends outwardly from the spindle in an opposite direction from the elongated arm portion, said elongated arm portion normally resting on said game board means, said counterweight portion including a weighted counterweight element which is centrifugally moved outwardly in the counterweight portion away from the spindle during rotation of said spinner arm about said spindle to pivot said elongated arm portion upwardly and counterbalance the elongated arm portion above said game board means, said counterweight element being gravitationally moved inwardly in said counterweight portion towards the spindle when rotation of said spinner arm is reduced to a level sufficient to cause the weight of said counterweight element to overcome the centrifugal force applied thereto, whereby the elongated arm portion is caused to slowly descend onto the game board means, said elongated arm portion coming to rest on one of said angular spaces.

6. In the game apparatus of claim 5, said counterweight portion including a housing and a supporting surface in said housing which slopes upwardly and away from said spindle, said counterweight element comprising a ball element which is received in said housing on said supporting surface, said ball element rolling upwardly and away from said spindle when said spinner arm is rotating around said spindle to pivot said elongated arm portion upwardly and counterbalance the elongated arm portion above said game board means, said ball element rolling downwardly toward said spindle when rotation of said spinner arm is reduced to a level sufficient to cause the weight of said ball element to overcome the centrifugal force applied thereto, whereby said elongated arm portion is caused to slowly descend onto said game board means.

7. In the game apparatus of claim 5, said elongated arm portion including platform means at one end thereof.

8. Game apparatus comprising:

game board means having a center area and a plurality of angular spaces which radiate outwardly from said center area;

a spinner base mounted in said center area of said game board means;

an upright spindle on said spinner base;

a spinner arm rotatably and pivotably mounted on said spindle and comprising an elongated arm portion which extends outwardly from said spindle, and a counterweight portion which extends outwardly from the spindle in an opposite direction from the elongated arm portion, said elongated arm portion including platform means at one end thereof which normally rests on said game board means, said counterweight portion including a weighted counterweight element which is centrifugally moved outwardly in the counterweight portion away from the spindle during rotation of said spinner arm about said spindle to pivot said elongated arm portion upwardly and counterbalance said elongated arm portion said game board means, said counterweight element being gravitationally moved inwardly in said counterweight portion towards the spindle when rotation of said spinner arm is reduced to a level sufficient to cause the weight of said counterweight element to overcome the centrifugal force applied thereto, whereby the elongated arm portion is caused to slowly descend onto the game board means, said elongated arm portion coming to rest on one of said angular spaces; and a plurality of character pawns which are mountable on said platform means.

9. Game apparatus comprising:

game board means having a center area and a plurality of angular spaces which radiate outwardly from said center area;

a spinner base mounted in said center area of said game board means;

an upright spindle on said spinner base;

a spinner arm rotatably and pivotably mounted on said spindle and comprising an elongated arm portion which extends outwardly from said spindle, and a counterweight portion which extends outwardly from the spindle in an opposite direction from the elongated arm portion, said elongated arm portion normally resting on said game board means, said counterweight portion including a weighted counterweight element which is centrifugally moved outwardly in the counterweight portion away from the spindle during rotation of said spinner arm about said spindle to pivot said elongated arm portion upwardly and counterbalance the elongated arm portion above said game board means, said counterweight element being gravitationally moved inwardly in said counterweight portion towards the spindle when rotation of said spinner arm is reduced to a level sufficient to cause the weight of said counterweight element to overcome the centrifugal force applied thereto, whereby the elongated arm portion is caused to slowly descend onto the game board means, said elongated arm portion coming to rest on one of said angular spaces;

support element fixedly mounted on said spindle;

second game board means mounted on said support member above said spinner arm; and spinner means rotatably mounted on said support member above said second game board means.

10. In the game apparatus of claim 9, said support element including an axial bore which is coaxial with said spindle, said spinner means including a spindle which is received in said bore, and an arm portion extending outwardly from said spindle.

11. In the game apparatus of claim 9, said second game board means having a generally circular configuration and a radius which is generally equal to a length of said elongated arm portion.

12. A spinner assembly comprising:

pivot means; and a spinner arm rotatably and pivotably mounted on said pivot means, said spinner arm including an arm portion extending outwardly from said pivot means, and a counterweight portion extending outwardly from said pivot means in an opposite direction from said arm portion, said arm portion normally resting on a supporting surface, said counterweight portion including a weighted counterweight element which is centrifugally moved radially outwardly away from said pivot means in response to a predetermined rotational speed of said spinner arm to pivot said arm portion upwardly and counterbalance said arm portion above said supporting surface, said counterweight portion further including means for causing said counterweight element to be moved radially inwardly towards said pivot means when rotation of said spinner arm is reduced to a level sufficient to cause the weight of said counterweight to overcome the centrifugal force applied thereto.

13. In the spinner assembly of claim 12, said counterweight element comprising a ball, and said means for causing said counterweight element to be moved comprising a supporting surface in said counterweight portion which slopes radially upwardly and outwardly, said ball being supported on said supporting surface, said ball element rolling upwardly on said supporting surface away from said pivot means in response to a predetermined rotational speed of said spinner arm, said ball element rolling downwardly on said supporting surface toward said pivot means when rotation of said spinner arm is reduced to a level sufficient to cause the weight of said ball of overcome the centrifugal force applied thereto.

* * * * *